US005119629A

United States Patent [19]

Kume et al.

[11] Patent Number: 5,119,629

[45] Date of Patent: Jun. 9, 1992

[54] METHOD OF AND APPARATUS FOR CONTROLLING AIR FUEL RATIO OF INTERNAL COMBUSTION ENGINE

[75] Inventors: Tateo Kume, Kyoto; Reijiro Komagome, Joyo; Katsuo Akishino, Kyoto; Yoshiaki Kodama, Kyoto; Michiyasu Yoshida, Kyoto; Toshio Yuminaka, Kyoto, all of Japan

[73] Assignee: Mitsubishi Jidosha Kogyo Kabushiki Kaisha, Tokyo, Japan

[21] Appl. No.: 372,562

[22] Filed: Jun. 28, 1989

[30] Foreign Application Priority Data

Jun. 29, 1988 [JP] Japan ..... 63-162312
Feb. 9, 1989 [JP] Japan ..... 63-31491

[51] Int. Cl.[5] ..... F01N 3/20
[52] U.S. Cl. ..... 60/274; 60/276
[58] Field of Search ..... 60/276, 274

[56] References Cited

U.S. PATENT DOCUMENTS 4,253,302 3/1981 Asano ..... 60/276
4,681,077 7/1987 Kobayashi ..... 123/489

FOREIGN PATENT DOCUMENTS 5314 1/1978 Japan ..... 60/276

*Primary Examiner*—Douglas Hart
*Attorney, Agent, or Firm*—Wegner, Cantor, Mueller & Player

[57] ABSTRACT

A method of and an apparatus for controlling the air fuel ratio of an internal combustion engine by which the air fuel ratio can be controlled so that the exhaust gas purifying efficiency of a catalytic converter for purifying exhaust gas of the engine may be maximum. In the apparatus, exhaust gas of the engine is first passed through a catalytic converter and then is introduced into an oxygen concentration sensor of the λ type. When the air fuel ratio is compulsorily varied, the compulsorily varied condition of the air fuel ratio such as an average of variations of the air fuel ratio (average air fuel ratio) is corrected in accordance with an output of the oxygen concentration sensor thereby to control the air fuel ratio so that the purifying efficiency of the exhaust gas purifying catalytic converter may be maximum.

22 Claims, 13 Drawing Sheets

FIG. 11
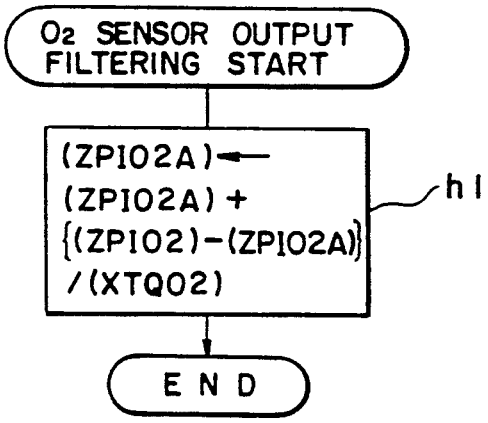
FIG. 12(a)
FIG. 12(b)
FIG. 12(c)
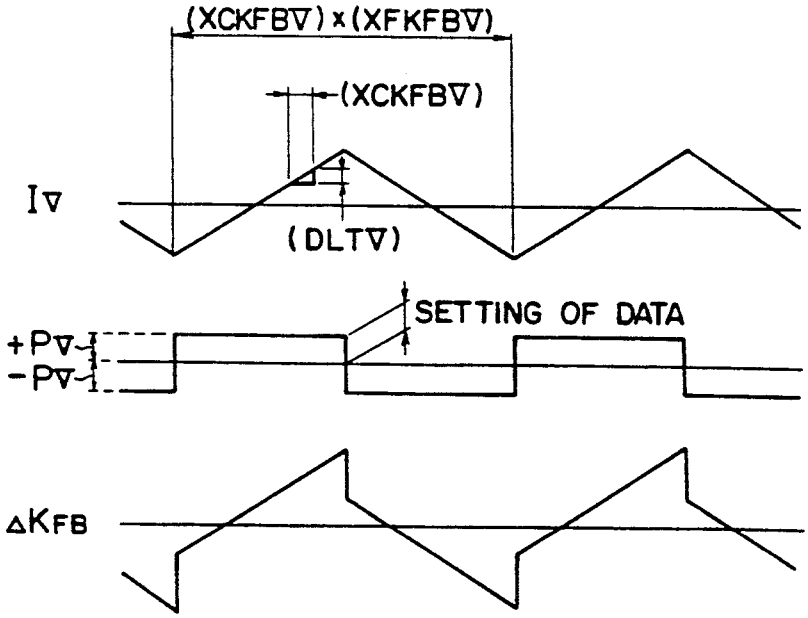

METHOD OF AND APPARATUS FOR CONTROLLING AIR FUEL RATIO OF INTERNAL COMBUSTION ENGINE

BACKGROUND OF THE INVENTION

1. Field of the Invention

This invention relates to a method of and an apparatus for controlling the air fuel ratio of an internal combustion engine.

2. Description of the Prior Art

An exhaust gas purifying system is conventionally known wherein catalytic converter rhodium for purifying exhaust gas of an internal combustion engine is disposed in an exhaust system of the internal combustion engine to purify exhaust gas of the engine.

It is already known that the exhaust gas purifying efficiency of such an exhaust gas purifying system can be improved by oscillating the air fuel ratio proximate the theoretical air fuel ratio (stoichiometric mixture ratio).

To this end, an oxygen concentration sensor of the λ type (which denotes an oxygen concentration sensor which presents a sudden change in output value therefore proximate a predetermined air fuel ratio (theoretical air fuel ratio, and such sensor will be hereinafter referred to as $O_2$ sensor) is conventionally provided in an intake manifold on the upstream side of a catalytic converter. Taking notice of the fact that the output of such $O_2$ sensor presents a change from an on-state to an off-state, that is, a change from a high voltage level to a low voltage level or vice versa at or proximate the theoretical air fuel ratio, the output of the $O_2$ sensor is fed back to control the air fuel ratio so that the air fuel ratio may have a value proximate the theoretical air fuel ratio. Such control is called $O_2$ feedback control.

In such $O_2$ feedback control, an output of the $O_2$ sensor is compared with an on/off criterion voltage (reference value), and if, for example, the $O_2$ sensor output is higher than the criterion voltage, the air fuel ratio is controlled so that it may become lean, but on the contrary, if the $O_2$ sensor output is lower than the criterion voltage, the air fuel ratio is controlled so that it may be rich.

With such conventional $O_2$ feedback control, however, there is the possibility that, if the $O_2$ sensor used for the feedback control suffers from a secular change or deterioration, the reliability in control may be deteriorated. Further, where the dispersion of $O_2$ sensors is great, the dispersion of emission levels is also great. Also this may possibly give rise to deterioration in reliability in control.

Further, since the maximum frequency of variations in air fuel ratio is restricted by a delay (wasteful time) in conveyance of gas from a fuel supply station to a location of the $O_2$ sensor as well as a delay in responding of the sensor, there is the possibility that the capacity of the catalyzer may not be exhibited sufficiently.

Means has thus been proposed for further improving the exhaust gas purifying characteristic of an exhaust gas purifying system of an internal combustion engine. Such means is disclosed, for example, in Japanese Patent Laid-Open No. 56-118535 wherein the air fuel ratio of air fuel mixture introduced into catalytic converter rhodium is varied positively so that a high purifying efficiency of the catalytic converter rhodium may be attained over a wide range of the air fuel ratio.

With the conventional means, however, since the median of variations of the air fuel ratio is invariable, there still is the possibility that the air fuel ratio may be varied proximate the maximum purifying efficiency of the catalytic converter rhodium due to a difference among air fuel ratio controlling apparatus or a secular change of the air fuel ratio controlling apparatus.

SUMMARY OF THE INVENTION

It is an object of the present invention to provide a method of and an apparatus for controlling the air fuel ratio of an internal combustion engine by which the air fuel ratio can be controlled so that the exhaust gas purifying efficiency of a catalytic converter for purifying exhaust gas of the engine may be maximized.

In order to attain the object, according to the present invention, exhaust gas of an internal combustion engine which has passed through a catalytic converter is introduced into an oxygen concentration sensor of the λ type, and when the air fuel ratio is compulsorily varied, the compulsorily varied condition of the air fuel ratio such as an average of variations of the air fuel ratio (average air fuel ratio) is corrected in accordance with an output of the oxygen concentration sensor then to control the air fuel ratio so that the purifying efficiency of the exhaust gas purifying catalytic converter may be maximum.

In particular, according to one aspect of the present invention, there is provided a method of controlling the air fuel ratio of an internal combustion engine which includes a catalytic converter provided in a exhaust system of the internal combustion engine for purifying exhaust gas discharged from a combustion chamber of the internal combustion engine, an oxygen concentration sensor of the λ type disposed in the exhaust system and having an output value which presents a sudden change proximate the theoretical air fuel ratio, an air fuel ratio modifying means for compulsorily varying the air fuel ratio of air fuel mixture to be introduced into the combustion chamber with a required cycle and a required magnitude to compulsorily change the excess air ratio λ of exhaust gas to be introduced into the catalytic converter, and a control means for controlling operation of the air fuel ratio modifying means in response to an output of the oxygen concentration sensor, the method comprising the steps of introducing into the oxygen concentration sensor exhaust gas which has passed through the catalytic converter or another catalytic converter which is provided independently of the catalytic converter, and controlling the compulsorily varied condition of the air fuel ratio by the air fuel ratio modifying means in response to an output of the oxygen concentration sensor so that the excess air ratio λ of exhaust gas to be introduced into the catalytic converter may be compulsorily varied proximate a value equal to 1.

According to another aspect of the present invention, there is provided an apparatus for controlling the air fuel ratio of an internal combustion engine, which comprises a catalytic converter interposed in an exhaust gas path of the internal combustion engine for purifying exhaust gas discharged from a combustion chamber of the internal combustion engine, an oxygen concentration sensor of the λ type located either in the inside of the catalytic converter or in the exhaust gas path on the downstream side of the catalytic converter and having an output value which presents a sudden change proximate the theoretical air fuel ratio, an air fuel ratio modifying means for compulsorily varying the air fuel ratio of air fuel mixture to be introduced into the combustion chamber with a required cycle and a required magnitude to compulsorily change the excess air ratio λ of exhaust gas to be introduced into the catalytic converter, and a control means for controlling operation of the air fuel ratio modifying means in response to an output of the oxygen concentration sensor, the excess air ratio λ of exhaust gas which is introduced into the catalytic converter being compulsorily varied proximate a value equal to 1.

According to a further aspect of the present invention, there is provided an apparatus for controlling the air fuel ratio of an internal combustion engine, which comprises a first catalytic converter interposed in an exhaust gas path of the internal combustion engine for purifying exhaust gas discharged from a combustion chamber of the internal combustion engine, an oxygen concentration sensor of the λ type located in the exhaust gas path on the upstream side of the catalytic converter and having an output value which presents a sudden change proximate the theoretical air fuel ratio, a second catalytic converter provided around or on the upstream side of the oxygen concentration sensor in the exhaust gas path such that exhaust gas may pass therethrough before it comes to the oxygen concentration sensor, an air fuel ratio modifying means for compulsorily varying the air fuel ratio or air fuel mixture to be introduced into the combustion chamber with a required cycle and a required magnitude to compulsorily change the excess air ratio λ of exhaust gas to be introduced into the first catalytic converter, and a control means for controlling operation of the air fuel ratio modifying means in response to an output of the oxygen concentration sensor, the excess air ratio λ of exhaust gas which is introduced into the first catalytic converter being compulsorily varied proximate a value equal to 1.

With the air fuel ratio controlling method and apparatus for an internal combustion engine according to the present invention, the air fuel ratio is compulsorily varied with a required cycle and a required magnitude by the air fuel ratio modifying means. Upon such variation, the compulsorily varied condition of the air fuel ratio by the air fuel ratio modifying means such as an average of variations of the air fuel ratio (average air fuel ratio) is controlled in accordance with an output of the oxygen concentration sensor, and consequently, the excess air ratio λ of exhaust gas introduced into the exhaust gas purifying catalytic converter is varied proximate a value equal to 1. Accordingly, there is an advantage that the air fuel ratio can be controlled so that the purifying efficiency of the catalytic converter may be maximum. In this instance, since the oxygen concentration sensor is acted upon by exhaust gas from which oxygen and unburnt combustible components such as HC and CO have been processed by the catalytic converter, the excess air ratio λ of the exhaust gas detected by the oxygen concentration sensor is very accurate. Accordingly, there is another advantage that the accuracy in control of the air fuel ratio is maintained in a very high condition.

The above and other objects, features and advantages of the present invention will become apparent from the following description and the appended claims, taken in conjunction with the accompanying drawings.

BRIEF DESCRIPTION OF THE DRAWINGS

FIG. 11 is a flow chart showing a routine of filtering of an $O_2$ sensor;

FIGS. 12(*a*), 12(*b*) and 12(*c*) are graphs illustrating operation of the air fuel ratio controlling apparatus when the air fuel ratio is compulsorily modified;

DESCRIPTION OF THE PREFERRED EMBODIMENTS

Figure 3:
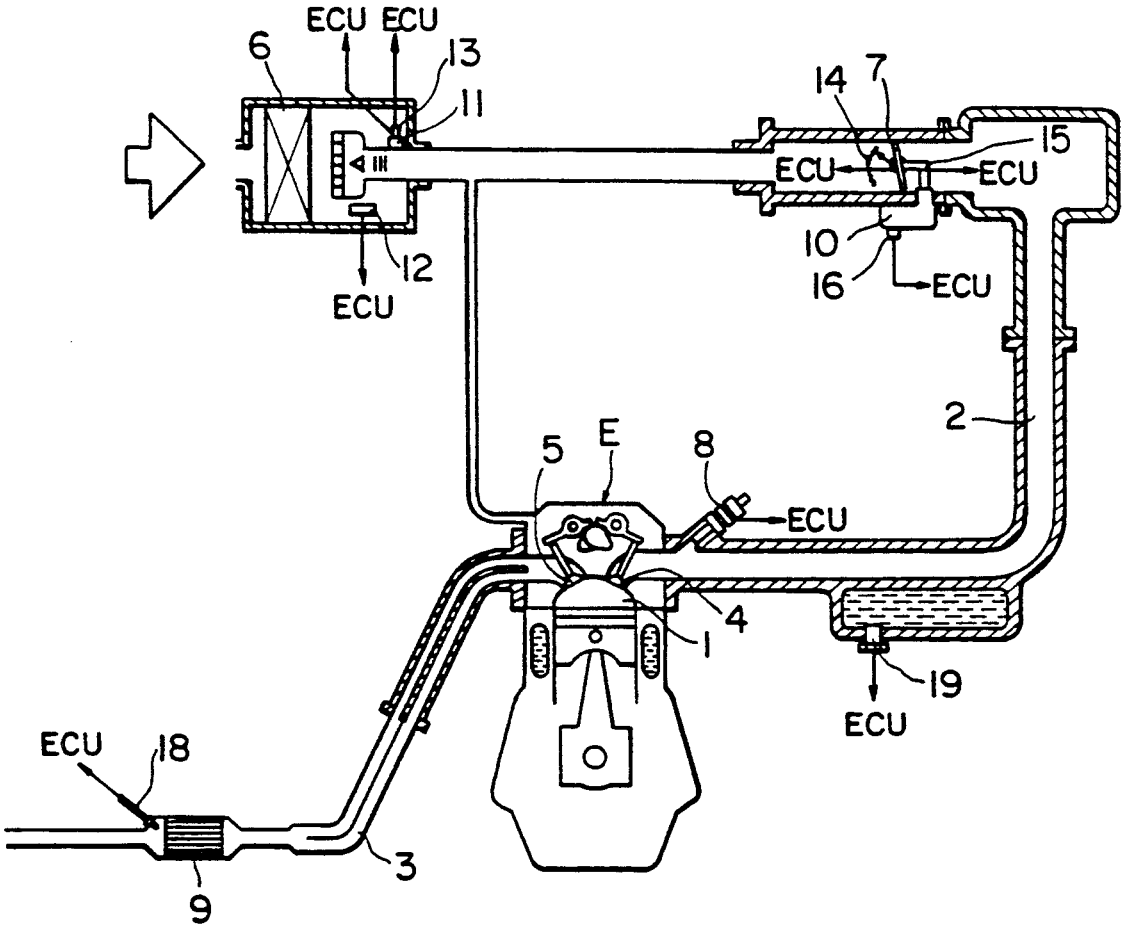
FIG. 3 is a diagrammatic representation showing an entire internal combustion in which the air fuel ratio controlling apparatus is incorporated.

Referring first to FIG. 3, there is shown in diagrammatic representation an entire internal combustion engine system in which an air fuel ratio controlling apparatus according to the present invention is incorporated. The engine system shown includes an engine (internal combustion engine) E which has an intake air passage or path 2 and an exhaust gas passage or path 3 both communicating with a combustion chamber 1 of the engine E. The intake air path 2 and the combustion chamber 1 are controlled by an intake valve 4 so that they may be communicated with or disconnected from each other while the exhaust gas path 3 and the combustion chamber 1 are controlled by an exhaust valve 5 so that they may be communicated with or disconnected from each other.

An air cleaner 6, a throttle valve 7 and an electromagnetic fuel injection valve (solenoid valve) 8 are provided in this order from the upstream side along the intake air path 2 while a catalytic converter (three-way catalyst) 9 for purification of exhaust gas and a muffler (not shown) are provided in this order from the upstream side along the exhaust gas path 3. A surge tank is provided for the intake air path 2.

Such solenoid valve 8 is provided by a number equal to the number of cylinders of the engine E and located at a portion of an intake manifold of the engine E. If it is assumed here that the engine E is a straight-type four-cylinder engine, the engine E includes up to four such solenoid valves 8. It can be thus said that the engine E is of the so-called multi-point fuel injection (MPI) type.

The throttle valve 7 is connected to an accelerator pedal not shown by way of a wire cable not shown such that the opening thereof may be varied in accordance with a treadled amount of the accelerator pedal. The throttle valve 7 is connected also to an idling speed controlling motor (ISC motor) 10 so that it may be driven to open or close by the latter. Accordingly, even if the accelerator pedal is not operated upon idling, the opening of the throttle valve 7 may be varied by the idling speed controlling motor 10.

With the internal combustion engine E having such a construction as described above, air is taken in by way of the air cleaner 6 is accordance with an opening of the throttle valve 7 and mixed in the intake manifold with fuel from the solenoid valve 8 so that a suitable air fuel ratio may be obtained. Then, the air fuel mixture is ignited at a suitable timing in a the combustion chamber 1 by an ignition plug so that the fuel is burnt with the air thereby to produce an engine torque. After then, the air fuel mixture is discharged as exhaust gas into the exhaust gas path 3, and then, the exhaust gas is purified by removing three detrimental components in the exhaust gas including CO, HC and $NO_X$ by means of the catalytic converter 9, whereafter it is discharged into the atmosphere by way of the muffler.

Various sensors are provided in order to enable suitable control of the engine E. In particular, an air flow sensor 11 for detecting an amount of intake air from Karman's vortex street information, an intake air temperature sensor 12 for detecting a temperature of intake air and an atmospheric pressure sensor 13 for detecting an atmospheric pressure are disposed at a location of the intake air path 2 at which the air cleaner 6 is provided. A throttle sensor 14 in the form of a potentiometer for detecting an opening of the throttle valve 7, an idling switch 15 for detecting an idling condition and a motor position sensor 16 for detecting a position of the ISC motor 10 are disposed at a location of the intake air path 2 at which the throttle valve 7 is provided.

Disposed at a location of the exhaust gas path 3 on the downstream side of the catalytic converter 9 is an oxygen concentration sensor 18 of the λ type (hereinafter referred to only as $O_2$ sensor 18) for detecting a concentration of oxygen ($O_2$ concentration) in exhaust gas. The $O_2$ sensor 18 of the λ type presents a sudden change in output value thereof proximate a predetermined air fuel ratio (theoretical air fuel ratio). Though not particularly shown, the $O_2$ sensor 18 is constructed such that a solid electrolyte layer formed from zirconia is put between a platinum electrode on the atmosphere side (reference electrode side) and another platinum electrode on the exhaust gas path side (measuring electrode side). The side $O_2$ sensor 18 generates an electromotive force ranging from 0 volts at the lowest to about 1 volt at the highest in response to a concentration of oxygen remaining in exhaust gas.

It is to be noted that the $O_2$ sensor may otherwise be disposed in the inside, for example, proximate an exit, of the catalytic converter 9.

Figure 1:
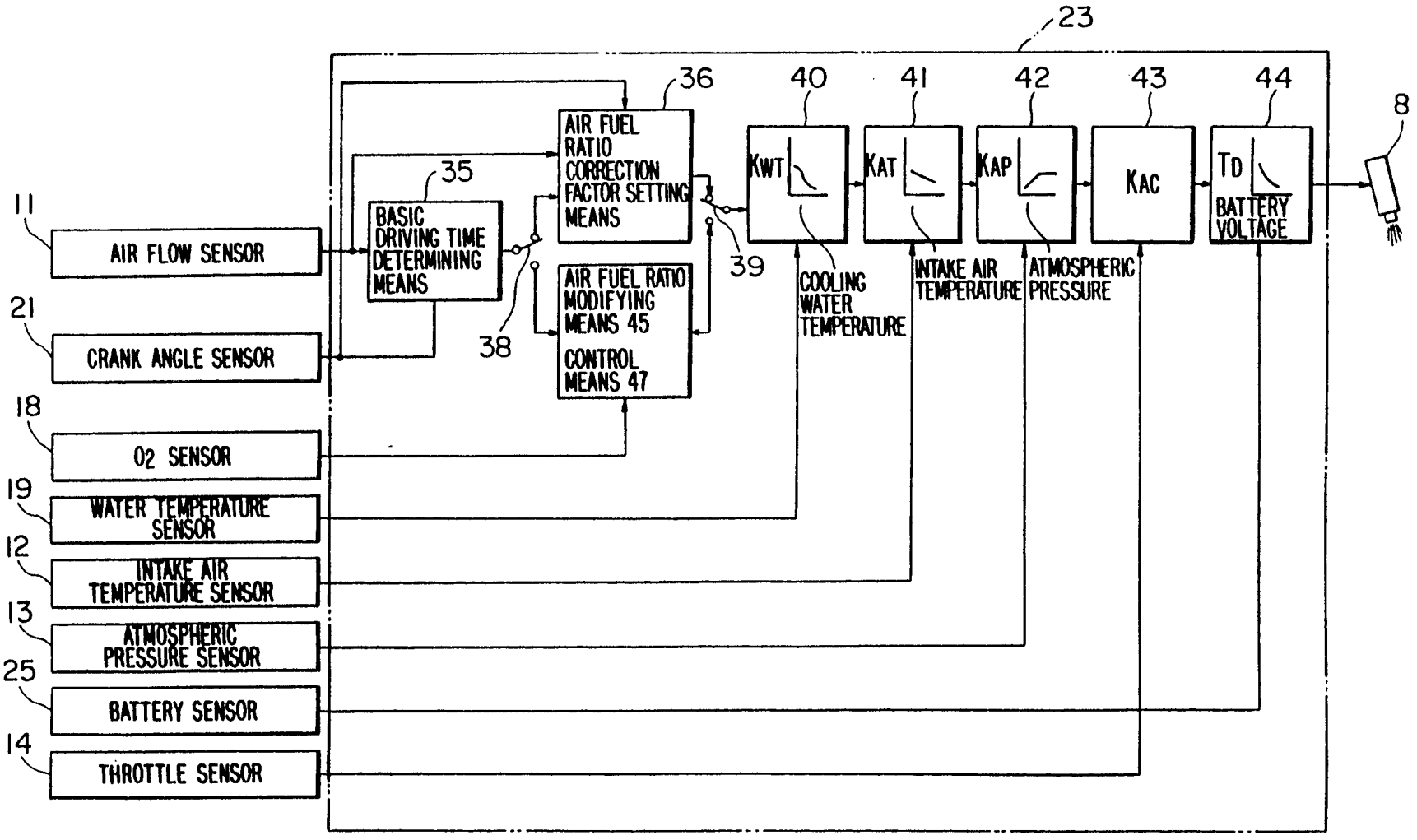
FIG. 1(*a*) is a block diagram of a fuel supply controlling device of an air fuel ratio controlling apparatus showing a first embodiment of the present invention, and FIG. 1(*b*) is a block diagram of an air fuel ratio modifying means and a control means of the air fuel ratio controlling apparatus.
Figure 1:
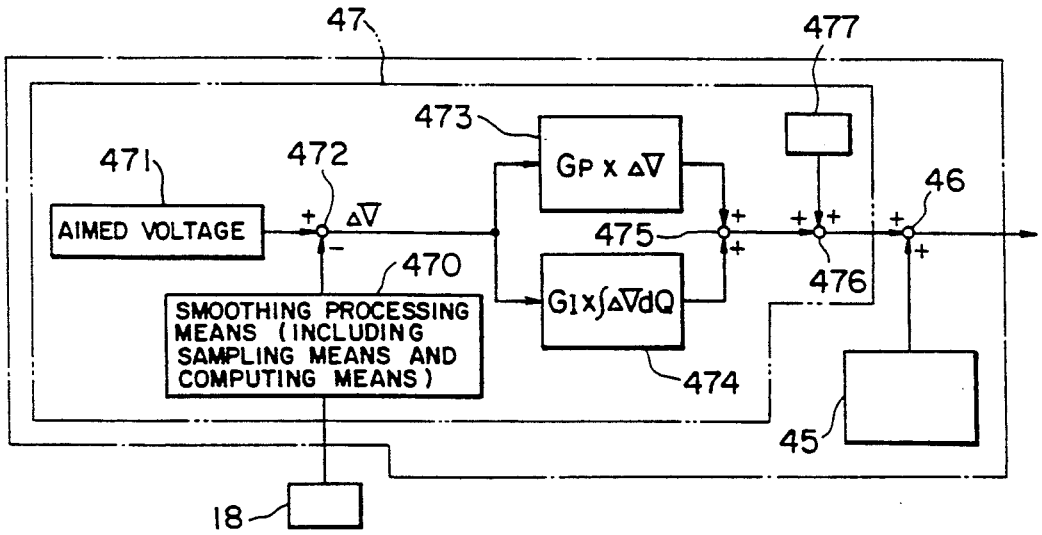
Figure 2:
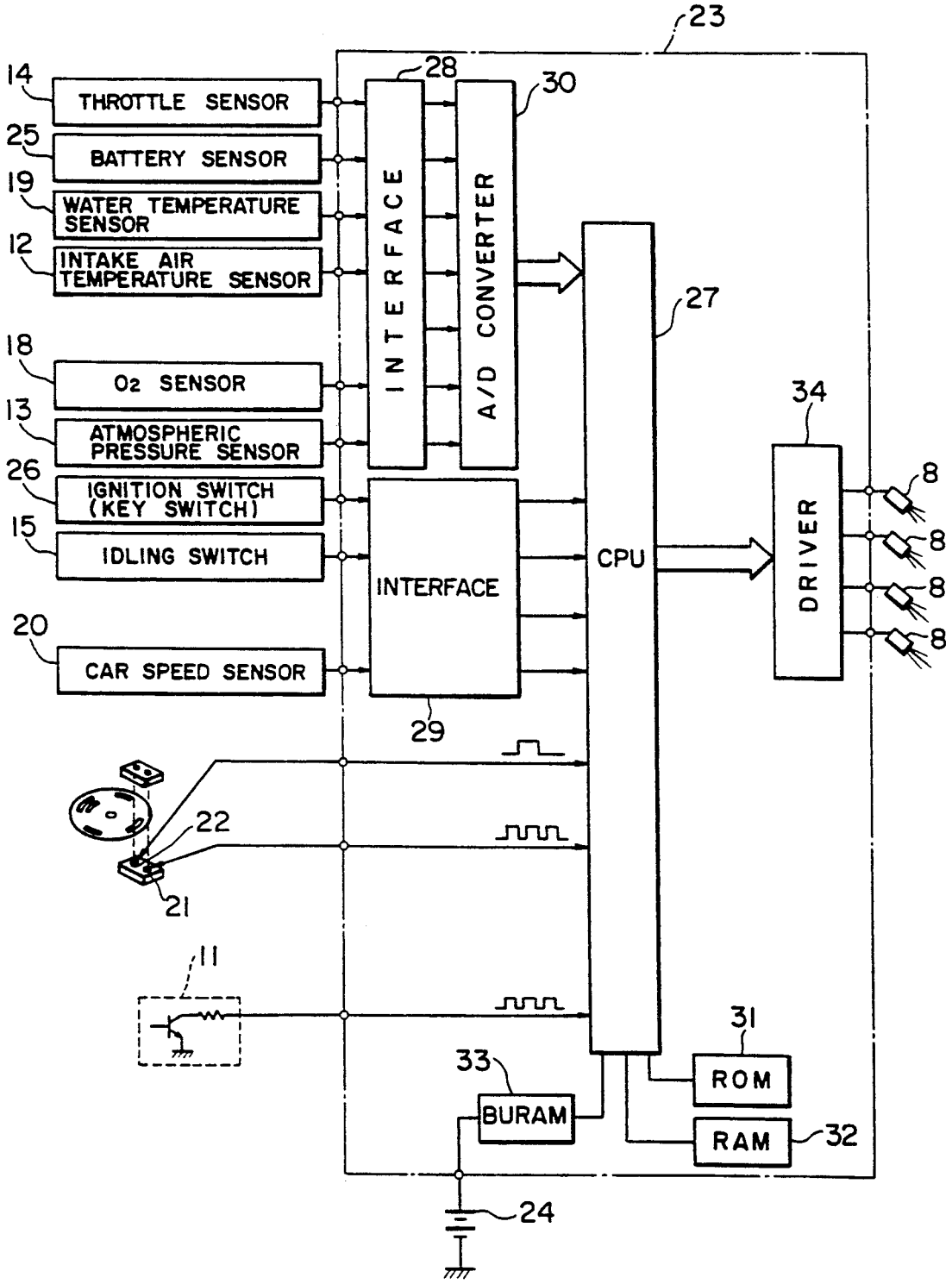
FIG. 2 is a block diagram principally showing a hardware construction of the air fuel ratio controlling apparatus.

A water temperature sensor 19 for detecting a temperature of engine cooling water and a car speed sensor 20 for detecting a car speed are also provided as seen in FIG. 2. Furthermore, referring to FIGS. 1(*a*) and 2, a crank angle sensor 21 for detecting a crank angle and a TDC (top dead center) sensor 22 for detecting a top dead center position of the first cylinder (reference cylinder) of the engine E are provided on a distributor (not shown) of the engine E. The crank angle sensor 21 serves also as a rotational speed sensor for detecting a rotational speed of the engine E.

Detection signals of the sensors 11 to 16 and 18 to 22 listed above are coupled to an electronic control unit (ECU) 23.

A voltage signal from a battery sensor 25 for detecting a voltage of a battery 24 and a signal from an ignition switch (key switch) 26 are also coupled to the ECU 23.

General hardware construction of the ECU 23 is shown in FIG. 2. Referring to FIG. 2, the ECU 23 includes a CPU (central processing unit) 27 as a primary component. The CPU 27 is connected to receive, by way of an input interface 28 and an analog to digital (A/D) converter 30, detection signals from the intake air temperature sensor 12, atmospheric pressure sensor 13, throttle sensor 14, $O_2$ sensor 18, water temperature sensor 19 and battery sensor 25. The CPU 27 is further connected to receive, by way of another input interface 29, detection signals from the idling sensor 15, car speed sensor 20 and ignition switch 26. The CPU 27 is also connected to receive directly at input ports thereof detection signals from the air flow sensor 11, crank angle sensor 21 and TDC sensor 22.

The CPU 27 is further connected by way of a bus line to deliver and receive data to and from a ROM (read only memory) 31 in which program data and invariable value data are stored in advance, a RAM (random access memory) 32 having therein stored data which are successively updated or rewritten, and a battery backed up RAM (BURAM) 33 having therein stored data which are backed up by the battery 24 while the battery 24 is held connected.

It is to be noted that stored data of the RAM 32 are canceled to put the RAM 32 into a reset state when the ignition switch 26 is turned off.

In fuel injection control (air fuel ratio control), a fuel injection controlling signal calculated in accordance with a method which will be hereinafter described is delivered from the CPU 27 by way of a driver 34 so that, for example, the four solenoid valves 8 may be driven in a predetermined sequence.

FIG. 1(*a*) shows a functional block diagram for such fuel injection control (solenoid valve driving time control). Referring to FIG. 1(*a*), the ECU 23 includes, from the point of view of software construction, a basic driving time determining means 35 for determining a basic driving time $T_B$ of the solenoid valves 8. The basic driving time determining means 35 receives information of an intake air amount Q from the air flow sensor 11 and information of an engine rotational speed Ne from the crank angle sensor 21, calculates information of an intake air amount Q/Ne for one complete rotation of the engine E, and determines a basic driving time $T_B$ in accordance with the last-mentioned information.

The ECU 23 further includes a cooling water temperature correcting means 40 for setting a correction factor $K_{WT}$ in accordance with a temperature of engine cooling water detected by the water temperature sensor 19, an intake air temperature correcting means 41 for setting a correction factor $K_{AT}$ in accordance with a temperature of intake air detected by the intake air temperature sensor 12, an atmospheric pressure correcting means 42 for setting a correction factor $K_{AP}$ in accordance with an atmospheric pressure detected by the atmospheric pressure sensor 13, an acceleration increment correcting means 43 for setting a correction factor $K_{AC}$ for increase in acceleration, and a dead time correcting means 44 for setting a dead time (invalid time) $T_D$ with which a driving time is to be corrected in accordance with a battery voltage detected by the battery sensor 25.

It is to be noted that the acceleration increment correcting means 43 receives either a signal of a rate of change of Q/Ne or a signal indicative of a rate of change of a throttle opening detected by the throttle sensor 14.

The ECU 23 further includes an air fuel ratio correction factor setting means 36 for setting an air fuel ratio correction factor $K_{AF1}$ in accordance with running conditions of the engine E (rotational speed of and/or load to the engine E).

The ECU 23 additionally includes an air fuel ratio modifying means 45 for setting a feedback correction factor $K_{FB}$ to compulsorily vary or oscillate the air fuel ratio with a required cycle (for example, 5 to 10 Hz or so) and a required magnitude, and a control means 47 for controlling the compulsorily varied condition of the air fuel ratio by the air fuel ratio modifying means 45 in accordance with an output of the $0_2$ sensor 18. One of outputs of the air fuel ratio modifying means 45 or control means 47 and the air fuel ratio correction factor setting means 36 is selected by means of a pair of switching means 38 and 39.

When one of the outputs is selected, the selected output is set as a factor $K_{AF}$. This is an operation in calculation of a fuel injection amount for setting data of an air fuel ratio correction factor $K_{AF1}$ and a feedback correction factor $K_{FB1}$ to a common memory (register) area.

Here, the control means 47 is constituted as a means for setting a factor $(K_{FB})_C$ with which an air fuel ratio median (or average value) is to be corrected in accordance with an output of the $0_2$ sensor 18 in order to change or correct the median (average value) of air fuel ratios. While the factor $(K_{FB})_C$ is referred to as air fuel ratio median (average value) correction factor hereinabove, it will be hereinafter referred to as air fuel ratio median correction factor $(K_{AF})_C$.

It is to be noted that a feedback correction factor $K_{FB}$ is represented as a sum of an air fuel ratio median correction factor $(K_{FB})_C$ and a compulsory oscillation variation $\Delta K_{FB}$.

Meanwhile, an air fuel ratio median correction factor $(K_{FB})_C$ is represented as $1.0+G_P\Delta V+G_I\cdot\int\Delta VdQ$ as will be hereinafter described. Here, $\Delta V$ is a variation (deviation) of an output of the $0_2$ sensor 18 and calculated in accordance with X02TL−ZPI02A where X02TL is an aimed voltage (for example, 0.5 volts), and ZPI02A is an output voltage of the $0_2$ sensor 18 after filtering processing, that is, smoothing processing. Such filtering processing will be hereinafter described. Further, $G_P$ is a proportional gain and $G_I$ is an integral gain, and they are data stored in the ROM in advance.

The air fuel ratio modifying means 45 and control means 47 described above are shown in a functional block diagram of FIG. 1(*b*). Referring to FIG. 1(*b*), the control means 47 includes a smoothing means 470, an aimed voltage setting means 471, a deviation calculating means 472 serving as a comparison means, a deviation proportional factor calculating means 473, a deviation integral factor calculating means 474, a pair of adding means 475 and 476, and a constant setting means 477.

Here, the smoothing means 470 is provided to smooth an output of the $0_2$ sensor 18 and includes a sampling means for successively sampling an output of the $0_2$ sensor 18, and a calculating means for repetitively calculating latest smoothed output data V(n) from a latest output v of the sampling means and smoothed output data V(n−1) calculated in the preceding cycle in accordance with the following equation.

$$V(n)=(1-k)\cdot V(n-1)+k\cdot V(0<k<1)$$

On the other hand, the aimed voltage setting means 471 is provided to set such an aimed voltage X02TL as described above while the deviation calculating means 472 is provided to compare the aimed voltage X02TL with an output voltage ZPI02A of the $0_2$ sensor 18 after filtering processing to find out a deviation $\Delta V$ between the two voltages.

The deviation proportional factor calculating means 473 is provided to calculate $G_P\Delta V$ from instantaneous value data among control data while the deviation integral factor calculating means 474 is provided to calculate $G_I\cdot\int\Delta VdQ$ from integrated value data among the control data.

The adding means 475 adds a result of a calculation $G_P\Delta V$ from the deviation proportional factor calculating means 473 and another result of a calculation $G_I\cdot\int\Delta VdQ$ from the deviation integral factor calculating means 474 while the other adding means 476 adds $G_P\Delta V+G_I\cdot\int\Delta VdQ$ and an output of the constant setting means 477.

An adding means 46 is also provided which adds an output of the adding means 477, that is, $1.0+G_P\Delta V+G_I\cdot\int\Delta VdQ=(K_{FB})_C$, and an output $\Delta K_{FB}$ of the air fuel ratio modifying means 45.

The solenoid valve 8 is thus driven for a required driving time $T_{INJ}=T_B\times K_{WT}\times K_{AT}\times K_{AP}\times K_{AC}\times K_{AF}+T_D$ calculated from time data and factors found out by such various means as described hereinabove.

Figure 5:
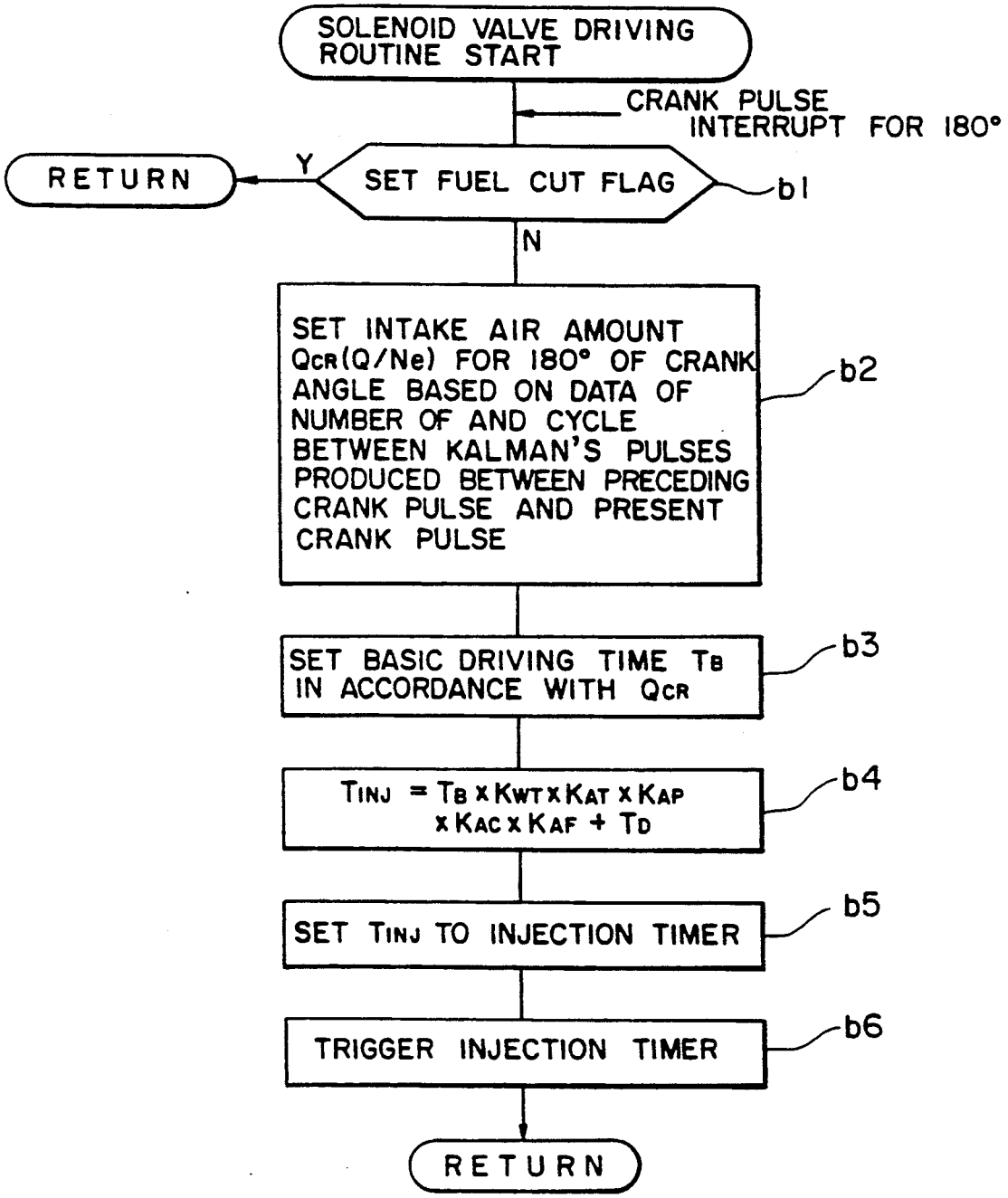
FIG. 5 is a flow chart showing a solenoid valve driving routine.

A control routine for such driving of the solenoid valve 8 is illustrated in the flow chart of FIG. 5. The control routine shown in FIG. 5 is entered by an interrupt in response to a crank pulse for each angular rotation of the crank shaft by 180 degrees. Referring to FIG. 5, it is judged at first at step b1 whether or not a fuel cut flag is in a set state. In case the fuel cut flag is in a set state, fuel injection is not required, and consequently, the sequence returns to a step of any control routine from which the present control routine shown in FIG. 5 has been entered. In the other case, however, the sequence advances to step b2 at which an intake air amount $Q_{CR}$ (Q/Ne) for each 180 degrees of the crank angle is set based on data of a number of and a cycle between Kalman's pulses produced between a preceding crank pulse and a present crank pulse.

Then at next step b3, a basic driving time $T_B$ is set in accordance with the intake air amount $Q_{CR}$, and then at step b4, a solenoid valve driving time $T_{INJ}$ is found out by a calculation of $T_B \times K_{WT} \times K_{AT} \times K_{AP} \times K_{AC} \times K_{AF} + T_D$. Subsequently at step b5, the solenoid valve driving time $T_{INJ}$ is set to an injection timer, and then at step b6, the injection timer is triggered. After such triggering, fuel will be injected for the period of time $T_{INJ}$.

Figure 4:
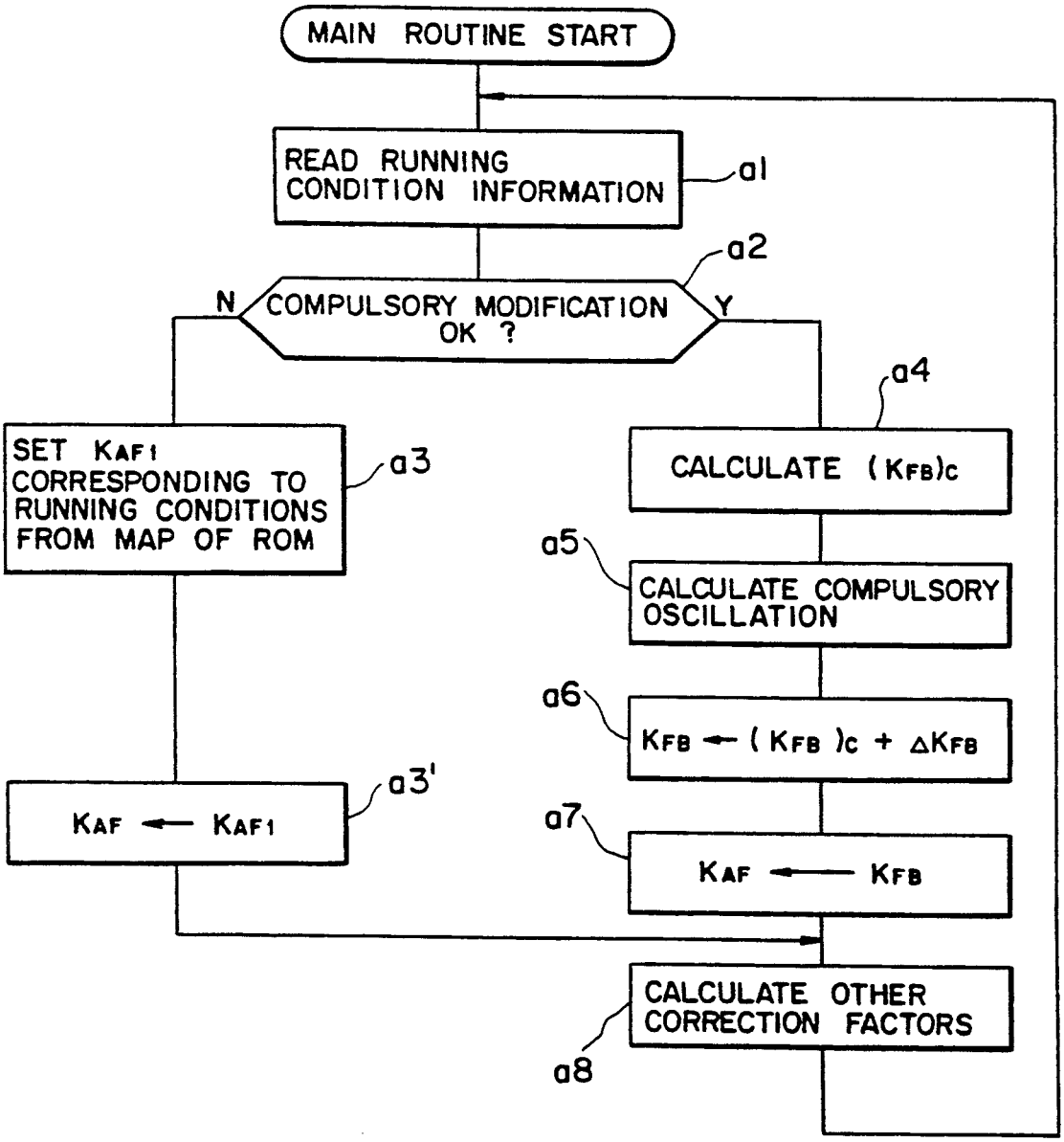
FIG. 4 is a flow chart of a main routine illustrating an outline of an air fuel ratio controlling method according to the present invention.

Subsequently, an outline of air fuel ratio control will be described with reference to the flow chart of FIG. 4 which shows a main routine of the same.

At first at step a1, the CPU 27 reads information of running conditions of the engine E from the various sensors described hereinabove. Then at step a2, the CPU 27 judges whether or not the engine E is in a particular running condition in which it is permitted to compulsorily vary or modify the air fuel ratio. Here, conditions or requirements for such compulsory variation of the air fuel ratio are such as follows:

(1) The $0_2$ sensor 18 is in an operative state.

(2) The running condition of the engine E remains within an air fuel ratio feedback control region (running condition, for example, wherein the load to the engine E is lower than a medium level).

(3) The intake air amount after the running condition of the engine enters the air fuel ratio feedback control region is greater than a predetermined value.

(4) The intake air amount after cutting of fuel is greater than a predetermined value.

(5) A predetermined interval of time has passed after starting of the engine E.

(6) The temperature of engine cooling water is higher than a predetermined value.

If the requirements listed above for compulsory variation of the fuel air ratio are not met, then the judgement at step a2 is in the negative, and the sequence thus advances to step a3 at which an air fuel ratio correction factor $K_{AF1}$ is set in accordance with the running conditions from a map of the ROM which is defined by Ne and Q/Ne. Then at step a3', the value $K_{AF1}$ is set to $K_{AF}$. Such setting is executed by the air fuel ratio correction factor setting means 36.

To the contrary, in case the requirements for compulsory variation of the fuel air ratio are met at step a2, the sequence advances to step a4 at which an air fuel ratio median correction factor $(K_{FB})_C$ is calculated and then to step a5 at which a compulsory oscillation variation $\Delta K_{FB}$ is calculated. Then at step a6, a feedback correction factor $K_{FB}$ is calculated in accordance with $(K_{FB})_C + \Delta K_{FB}$, and then, the value $K_{FB}$ is set to $K_{AF}$ at subsequent step a7. It is to be noted that the operations at steps a4 to a7 are executed by the control means 47 (deviation calculating means 472, deviation proportional factor calculating means 473, deviation integral factor calculating means 474, adding means 475 and 476, and so forth) and the air fuel ratio modifying means 45.

After execution of either of steps a3' and a7, the sequence advances to step a8 at which the remaining factors $K_{WT}$, $K_{AT}$, $K_{AP}$ and $K_{AC}$ are calculated. After then, the sequence returns to step a1.

Figure 6:
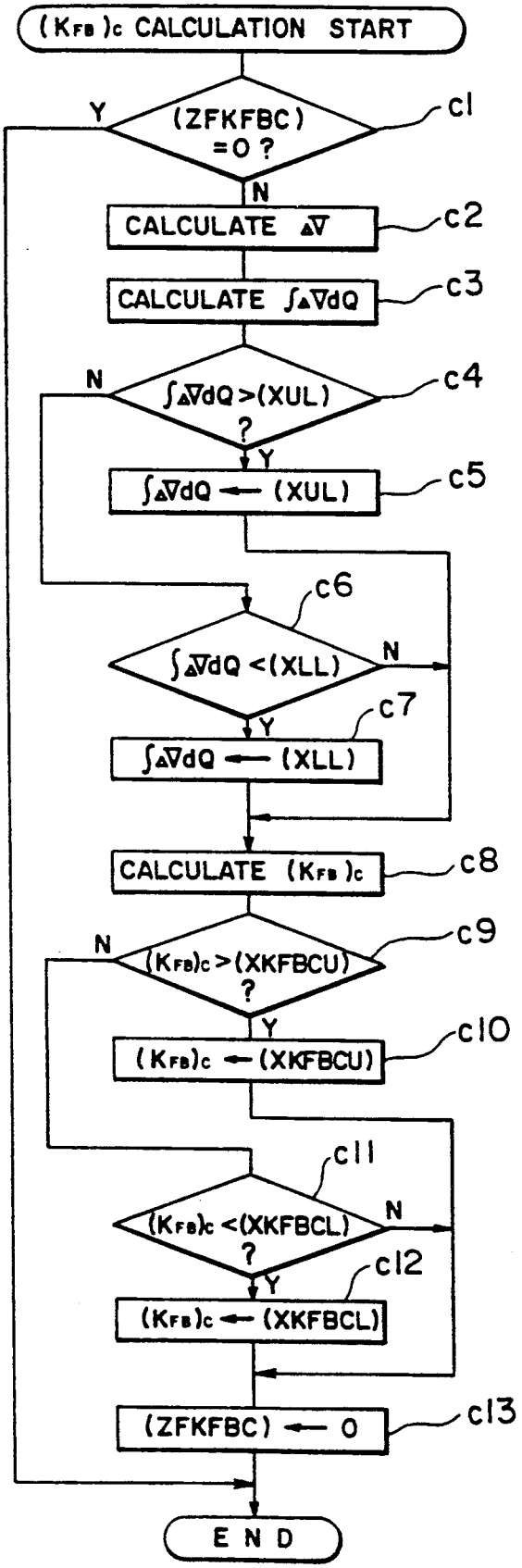
FIG. 6 is a flow chart showing an air fuel ratio median calculating routine.

Subsequently, a routine for the calculation of an air fuel ratio median correction factor $(K_{FB})_C$ executed at step a4 of FIG. 4 will be described more in detail with reference to FIG. 6. It is to be noted that the routine of the flow chart of FIG. 6 is executed by a function of the deviation calculating means 472 in the ECU 23 and a function of an updating means for updating control data with which operation of the air fuel ratio modifying means 45 is to be controlled. In the calculation routine of FIG. 6, it is judged at first at step c1 whether an air fuel ratio median calculation flag ZFKFBC is in a set state or in a reset state. In case the flag ZFKFBC is ZFKFBC=0 (in a reset state), a calculation of an air fuel ratio median correction factor $(K_{FB})_C$ is not executed subsequently and the sequence returns to step a4 of FIG. 4, but otherwise if ZFKFBC≠0 (in a set state) is judged, an air fuel ratio median correction factor $(K_{FB})_C$ is calculated subsequently and the value thereof is updated (learned) in the following steps of the routine.

Figure 9:
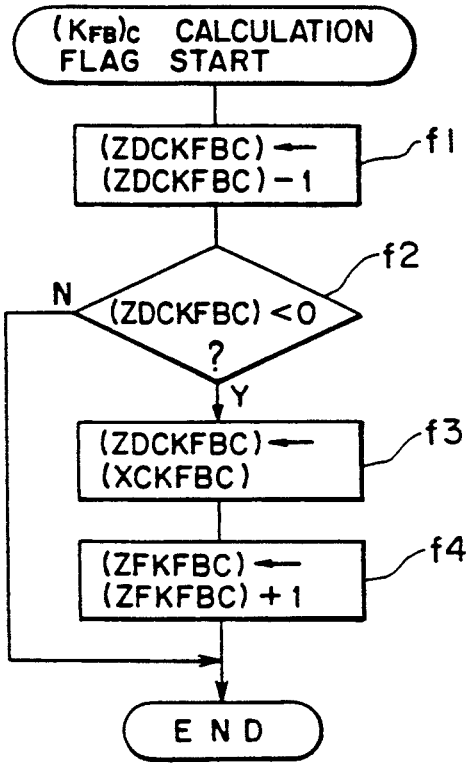
FIG. 9 is a flow chart showing a routine of setting of an air fuel ratio median calculation flag.

The flag ZFKFBC is set in a routine illustrated in FIG. 9. Referring now to FIG. 9, at first at step f1, a counter or register ZDCKFBC is decremented by one (ZDCKFBC←ZDCKFBC−1) each time a Kalman's pulse is received. A value XCKFBC is set in advance as an initial value to the counter ZDCKFBC, and the counter ZDCKFBC has a function of dividing Kalman's pulses in order to define a timing for the calculation of an air fuel ratio median correction factor $(K_{FB})_C$. The initial value XCKFBC thus represents a cycle for the calculation of an air fuel ratio median correction factor $(K_{FB})_C$. It is to be noted that information of an intake air flow rate (flow rate of working fluid of the engine E) as represented by Kalman's pulses has a predetermined correlation to a flow rate of exhaust gas.

Then, the sequence advances from step f1 to step f2 at which it is judged whether or not the value of the counter ZDCKFBC is smaller than 0 (ZDCKFBC<0). In case ZDCKFBC<0, the initial value XCKFBC is set to the counter ZDCKFBC at subsequent step f3, and the value of the counter ZDCKFBC is incremented by one at next step f4.

Each time the sequence advances to step f4, the flag ZFKFBC is incremented by one unless the value thereof becomes equal to zero. Accordingly, the value of the flag ZFKFBC also has information of an amount of intake air. In other words, the flag ZFKFBC not only has a function as a flag for the calculation of an air fuel ratio median correction factor $(K_{FB})_C$ but also provides information of an intake air amount which is used for the calculation of such air fuel ratio median correction factor $(K_{FB})_C$.

Setting of the flag ZFKFBC is executed in such a manner as described above. After such setting is executed, the flag ZFKFBC presents a value other than zero. Consequently, at step c1 of the routine shown in FIG. 6, the judgment then is in the negative, and accordingly, the sequence advances to step c2. At step c2, a deviation ΔV is calculated. Such calculation is executed by the deviation calculating means 472. It is to be noted that the deviation ΔV is calculated in accordance with X02TL−ZPI02A as described hereinabove.

Here, X02TL is an aimed voltage, and ZPI02A is an output voltage of the $0_2$ sensor 18 after filtering processing. In this instance, the filtering processing is a processing wherein a value obtained by suitable weighting between a present output value of the $0_2$ sensor 18 and an output value used in the preceding calculating is determined as an output value of the $0_2$ sensor 18. A flow chart for such processing is shown in FIG. 11.

Referring to FIG. 11, a value obtained by ZPI02A+(ZPI02−ZPI02A)/XTQ02 is determined as a new value of ZPI02A at single step h1. Here, ZPI02 is an instantaneous value of the output of the $0_2$ sensor 18 (the value is obtained by analog to digital conversion of the output value after each required interval of time), and XTQ02 is a value (pulse number) corresponding to a time constant of a means for the filtering processing (a so-called filtering circuit).

Now, deforming ZPI02A+(ZPI02−ZPI02A)/XTQ02, we obtain $$(1-1/XTQ02)ZPI02A+(1/XTQ02)ZPI02=(1-k)\cdot ZPI02A+k\cdot ZPI02$$

where k is a weighting factor and is set to a value defined by $0 \leqq k \leqq 1$ (normally $k \neq 0$ and $k \neq 1$).

It is to be noted that the equation given just above has a same form as the equation $$V(n)=(1-k)\cdot V(n-1)+kV$$

given hereinbefore.

Output noise components are thus cut if the filtering processing of an output of the $O_2$ sensor 18 is executed in this manner.

Referring back to FIG. 6, after the calculation at step c2 of the deviation ΔV in accordance with the output of the $O_2$ sensor 18 after the filtering processing, a deviation integrated value ∫ΔVdQ is calculated at subsequent step c3. The processing is executed by the deviation integral factor calculating means 474. It is to be noted that the value ∫ΔVdQ is calculated by addition of a variation ΔV×ZFKFBC×XCRFBC to the present value of ∫ΔVdQ.

Here, ZFKFBC×XCKFBC corresponds to a number of Kalman's pulses, that is, an intake air amount. Accordingly, the description that ZFKFBC provides information of an intake air amount used for the calculation of an air fuel ratio median correction factor $(K_{FB})_C$ signifies this.

After such calculation at step c3, a processing to restrict the deviation integrated value ∫ΔVdQ within a predetermined range (for example, −100 to 100 Vl) is executed. In particular, at step c4, it is judged whether or not ∫ΔVdQ is greater than an upper limit value XUL. In case ∫ΔVdQ is greater than XUL, then the upper limit value XUL is set to the deviation integrated value ∫ΔVdQ to clip an upper limit of the value ∫ΔVdQ at step c5, whereafter the sequence advances to step c8. On the contrary, if the value ∫ΔVdQ is not greater than the upper limit value XUL at step c3, then it is judged at step c6 whether or not the value ∫ΔVdQ is smaller than a lower limit value XLL, and if the value ∫ΔVdQ is smaller than the lower limit value XLL, the lower limit value XLL is set to the deviation integrated value ∫ΔVdQ to clip a lower limit of the value ∫ΔVdQ at step c7, whereafter the sequence advances to step c8. Also when it is judged at step c6 that the value ∫ΔVdQ is not smaller than the lower limit value XLL, the sequence advances to step c8.

After the value ∫ΔVdQ is restricted within the predetermined range in this manner, an air fuel ratio median correction factor $(K_{FB})_C$ is calculated at step c8 using the values ΔV and ∫ΔVdQ to thus update the value of the air fuel ratio median correction factor $(K_{FB})_C$. In particular, a processing of $(K_{FB})_C \leftarrow 1.0+G_P\cdot\Delta V+G_I\cdot\int\Delta VdQ$ is executed. Here, $G_P$ is a proportional gain, and $G_I$ is an integral gain, as described hereinabove.

The calculations are executed by the deviation proportional factor calculating means 473, deviation integral factor calculating means 474, adding means 475 and 476 and so forth which constitute the updating means described hereinabove.

After then, a processing is executed to restrict the updated value $(K_{FB})_C$ within a predetermined range (for example, 0.8 to 1.2). In particular, at step c9, it is judged whether or not the value $(K_{FB})_C$ is greater than an upper limit value XKFBCU. In case the judgment is in the affirmative, the upper limit value XKFBCU is set to the value $(K_{FB})_C$ to clip an upper limit of the value $(K_{FB})_C$ at step c10, whereafter the sequence advances to step c13. On the contrary, if the judgment at step c9 is in the negative, then it is judged at subsequent step c11 whether or not the value $(K_{FB})_C$ is smaller than a lower limit value XKFBCL. If the judgment is in the affirmative, then the lower limit value XKFBCL is set to the value $(K_{FB})_C$ to clip a lower limit of the value $(K_{FB})_C$, whereafter the sequence advances to step c13. Also when it is judged at step c11 that the value $(K_{FB})_C$ is not smaller than the lower limit value XKFBCL, the sequence advances to step c13.

By the processing, the air fuel ratio median correction factor $(K_{FB})_C$ is updated within the required range.

After the factor $(K_{FB})_C$ is restricted within the predetermined range in this manner, the flag ZFKFBC is reset to 0 at step c13, whereafter the sequence returns to any step from which the present routine has been entered.

Figure 7:
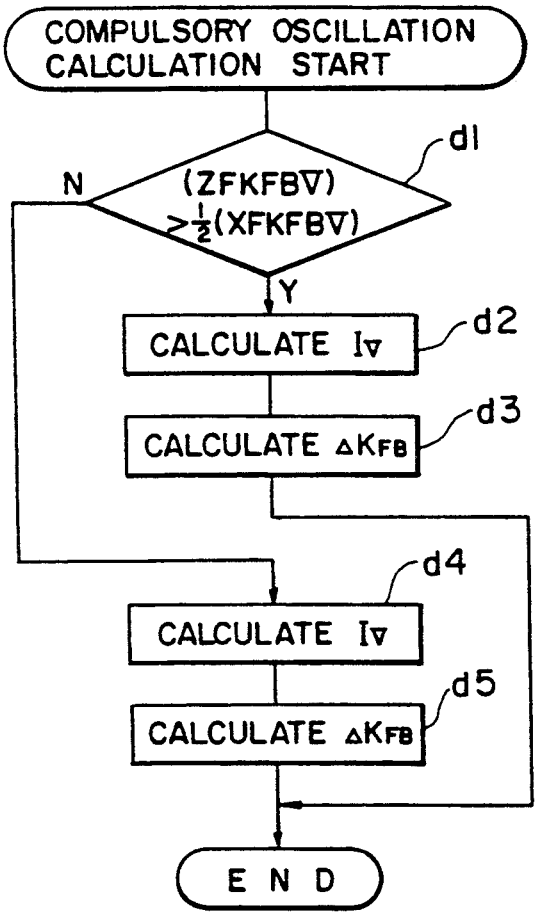
FIG. 7 is a flow chart showing a routine of calculation of an amount by which the air fuel ratio is to be compulsorily modified.

Subsequently, a routine for the calculation of compulsory oscillations executed at step a5 of FIG. 4 will be described with reference to FIG. 7. In the routine shown, it is judged at first at step d1 whether or not the value of a counter ZFKFBV is greater than one half a compulsory oscillation cycle XFKFBV of, for example, 5 to 10 Hz.

It is to be noted that the compulsory oscillation cycle XFKFBV is smaller than an oscillation cycle (normally 2 to 5 Hz or so) in ordinary air fuel ratio feedback control wherein feedback control of the air fuel ratio is executed in accordance with a detection signal from the $O_2$ sensor which is provided proximate an exit of the combustion chamber 1 on the upstream side of the catalytic converter 9.

Figure 10:
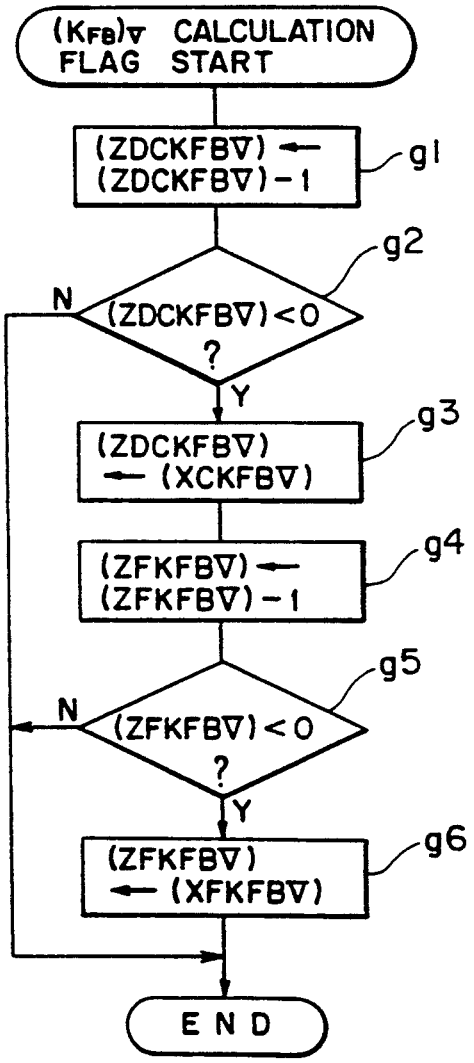
FIG. 10 is a flow chart showing a routine of incrementing of an air fuel ratio modification calculation timer.

Here, the value of the timer ZFKFBV is incremented in accordance with the flow chart shown in FIG. 10. Referring to FIG. 10, at first at step g1, the value of a counter ZDCKFBV is decremented by one each time a Kalman's pulse is received (ZDCKFBV←ZDCKFBV−1). The counter ZDCKFBV has an initial value XCKFBV set in advance therein and has a function of dividing Kalman's pulses in order to define a timing for the calculation of a compulsory oscillation variation $\Delta K_{FB}$. In other words, a timing for the calculation of a compulsory oscillation variation $\Delta K_{FB}$ comes after each lapse of an interval of time defined by the initial value XCKFBV.

After then, it is judged at step g2 whether or not the value of the counter ZDCKFBV is smaller than zero (ZDCKFBV<0). If ZDCKFBV<0, then the initial value XCKFBV is set to the counter ZDCKFBV at step g3, and the value of the timer ZFKFBV is decremented by one at step g4.

Subsequently at step g5, it is judged whether or not the value of the timer ZFKFBV is smaller than 0 (ZFKFBV<0), and if ZFKFBV<0, then the compulsory oscillation cycle XFKFBV is set to the timer ZFKFBV at step g6. After then, the sequence returns to an original step from which the present routine has been entered. Also when it is not judged at step g2 that the value of the counter ZDCKFBV is smaller than zero or when it is not judged at step g5 that the value of the timer ZFKFBV is smaller than 0, the sequence returns to such original step.

In this manner, a timing for the calculation of a compulsory oscillation variation $\Delta K_{FB}$ can be produced after each lapse of an interval of time defined by the initial value XCKFBV as a unit one of intervals of time into which the compulsory oscillation cycle XFKFBV is divided.

The count value of the timer ZFKFBV is obtained in such a manner as described above. A processing of making the air fuel ratio richer and another processing of making the air fuel ratio leaner are executed separately on the opposite sides of a point of time when the timer value ZFKFBV assumes just one half the compulsory oscillation cycle XFKFBV.

In particular, referring back to FIG. 7, if it is judged at step d1 that the timer value ZFKFBV is greater than one half the compulsory oscillation cycle XFKFBV, then a processing for making the air fuel ratio richer is executed subsequently. But on the contrary, if it is not judged at step d1 that the timer value ZFKFBV is greater than one half the compulsory oscillation cycle XFKFBV, then a processing for marking the air fuel ration leaner is subsequently executed.

For the processing for making the air fuel ratio richer, at first at step d2, a compulsory oscillation integral component $I_V$ for making the air fuel ratio richer is calculated in accordance with the following equation, $$I_V=\{(\tfrac{3}{4})XFKFBV-ZFKFBV\}\times DLTV$$

where DLTV is a value which is to be added for each execution of the calculation.

After then, a compulsory oscillation component $\Delta K_{FB}$ for making the air fuel ratio richer is calculated in accordance with $P_V+I_V$, where $I_V$ is the value calculated at step d2 above, and $P_V$ is a compulsory oscillation proportional component.

To the contrary, for the processing for making the air fuel ratio leaner, at first at step d4, a compulsory oscillation integral component $I_V$ for making the air fuel ratio leaner is calculated in accordance with the following equation.

$$I_V=\{XFKFBV-(\tfrac{1}{4})ZFKFBV\}\times DLTV$$

After then, a compulsory oscillation component $\Delta K_{FB}$ for making the air fuel ratio leaner is calculated in accordance with $-P_V+I_V$, where $I_V$ is the value calculated at step d4 above.

The compulsory oscillation variation $\Delta K_{FB}$ is calculated in this manner. Since the timing for the calculation of such compulsory oscillation variation $\Delta K_{FB}$ has a synchronized relationship with Kalman's pulses, the cycle time of the compulsory oscillation variation $\Delta K_{FB}$ is a function of an intake air amount, and consequently, the oscillation cycle is varied in response to an intake air amount. Accordingly, a suitable oscillation cycle can be set in accordance with a change in intake air amount.

The values $I_V$, $P_V$ and $\Delta K_{FB}$ present such variations as shown in FIGS. 12(*a*), 12(*b*) and 12(*c*), respectively. In this instance, the compulsory variation presents such triangular wave oscillations as seen from FIG. 12(*c*).

Figure 8:
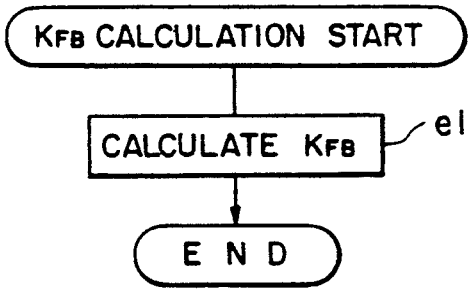
FIG. 8 is a flow chart showing a feedback correction factor calculating routine.

After an air fuel ratio median correction factor $(K_{FB})_C$ and a compulsory oscillation variation $\Delta K_{FB}$ have been found out in such a manner as described above, a calculation of a feedback correction factor $K_{FB}$ is executed at step a6 of FIG. 4 as described hereinabove. Such calculation is executed in accordance with a routine of the flow chart shown in FIG. 8. The routine of FIG. 8 includes a single step e1 at which a feedback correction factor $K_{FB}$ is calculated. After such calculation, the value $K_{FB}$ obtained at step a6 is set to the register $K_{AF}$ at step a7 of FIG. 4, and then the remaining factors are calculated at step a8 of FIG. 4.

With the construction described above, when the engine is in a running condition wherein compulsory oscillations are permitted, an air fuel ratio median correction factor $(K_{FB})_C$ and a compulsory oscillation variation $\Delta K_{FB}$ are calculated in order that an average fuel injection amount may be fed back to execute such control that the output (actually a filtered output) ZPIO2A of the $O_2$ sensor 18 provided on the downstream side or in the inside of the catalytic converter 9 may coincide with the aimed voltage XO2TL to update (learn) the air fuel ratio median correction factor $(K_{FB})_C$, and the air fuel ratio is fluctuated with a required cycle (which is a function of an intake air amount) and a required magnitude around a median at which the air fuel ratio is determined with the air fuel ratio median correction factor $(K_{FB})_C$.

In case the air fuel ratio is varied compulsorily in this manner, the median in variation thereof is corrected with an output of the $O_2$ sensor 18 then. Accordingly, the air fuel ratio can be controlled so that the purifying efficiency of the catalytic converter may present a maximum level.

Further, since the $O_2$ sensor 18 is provided on the downstream side or in the inside of the catalytic converter 9, unburnt components in exhaust gas are reduced and the control $\lambda$ point (point at which the output of the $O_2$ sensor 18 presents a sudden change) approaches the theoretical air fuel ratio, and besides the fluctuation in emission level is reduced. In addition, since the influence in delay in response peculiar to the engine system can be eliminated, a high exhaust gas purifying characteristic can be anticipated also from the point.

It is to be noted that, while latest values of the deviation integration value $\int\Delta VdQ$ and the compulsory oscillation variation $\Delta K_{FB}$ described above are stored in the RAM, the stored values are maintained until the battery is unloaded or the engine key is brought into an off-state.

Further, the deviation integration value $\int\Delta VdQ$ and hence the compulsory oscillation variation $\Delta K_{FB}$ may be stored for each of several running regions of the engine. In this instance, only when the engine is within a certain running region, latest values of the deviation integration values $\int\Delta VdQ$ as well as the compulsory oscillation variation $\Delta K_{FB}$ may be updated and stored, but when the engine is in any other running region, the values of the deviation integration value $\int\Delta VdQ$ as well as the compulsory oscillation variation $\Delta K_{FB}$ may be reset. Or when the running condition of the engine is changed from a certain running region to another running region, values of the deviation integration value $\int\Delta VdQ$ and the compulsory oscillation variation $\Delta K_{FB}$ just prior to such change may be stored, and when the running condition of the engine then returns to the certain running region, the values just prior to such change may be restored to execute updating of latest values.

Furthermore, the compulsory oscillations described above may be any of such oscillations as, in addition to the triangular wave oscillations described above, rectangular wave oscillations (refer to FIGS. 13 and 14), sine wave oscillations or some other composite wave oscillations.

Figure 13:
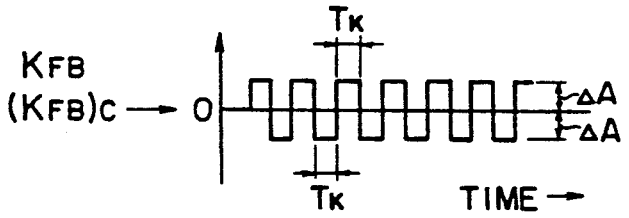
FIGS. 13 and 14 are graphs illustrating operation or a modified air fuel ratio controlling apparatus when the air fuel ratio is compulsorily modified.

Here, also in the case of FIG. 13, $K_{FB}$ and $(K_{FB})_C$ are given as follows.

$$K_{FB}=(K_{FB})_C+K_{FB}$$

$$(K_{FB})_C=1.0+G_P\Delta V+G_I\cdot\int\Delta VdQ$$

On the other hand, $\Delta V$ is given by XO2TL−ZPIO2A.

Meanwhile, $G_P$ and $G_I$ are mapped for the Kalman's frequency, and values of $\int\Delta VdQ$ as well as $K_{GB}$ are updated (learned) for each of the running regions of the engine.

Further, the magnitude $\Delta A$ and the rectangular width $T_K$ may be mapped for the Kalman's frequency or for a reciprocal number to the Kalman's frequency, or alternatively they may have constant values (including a case wherein they have constant values for the entire running region of the engine and another case wherein they have constant values for each of a plurality of portions of the running region of the engine).

Figure 14:
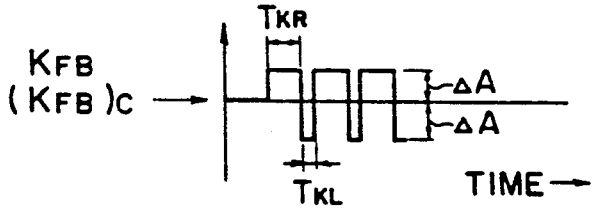

To the contrary, in the case of FIG. 14, the ratio between a period of time $T_{KR}$ within which the air fuel ratio presents a rich side value with respect to a median and another period of time $T_{KL}$ within which the air fuel ratio presents a lean side value with respect to the median is controlled. In this case, $K_{FB}$ and $(K_{FB})_C$ are given as follows.

$$K_{FB}=(K_{FB})_C+\Delta K_{FB}$$

$$(K_{FB})_C=1.0+G_I\cdot\int\Delta VdQ$$

On the other hand, a relationship between the rich side rectangular width $T_{KR}$ and the lean side rectangular width $T_{KL}$ is given by $$T_{KR}/T_{KL}=1.0+G_P\Delta V.$$

Thus, $$T_{KR}=T_K(1.0+G_P\Delta V)^{\frac{1}{2}},$$

and $$T_{KR}=T_K(1.0+G_P\Delta V)^{-\frac{1}{2}}.$$

In this instance, as can be seen from the relations of the equations given above, the air fuel ratio variation controlling means is constituted such that at least it may control a ratio between a time width within which the air fuel ratio presents a lean side value and another time width within which the air fuel ratio presents a rich side value in accordance with an output of the comparison means described hereinabove. More particularly, the control data include instantaneous value data set in accordance with a latest output of the comparison means and an integrated value data which is increased or decreased in accordance with an output of the comparison means, and the ratio is controlled in accordance with the instantaneous value data while the median of the air fuel ratio is controlled in accordance with the integrated value data.

Meanwhile, $G_P$ and $G_I$ are mapped for the Kalman's frequency similarly to those described hereinabove, and the values of $\int\Delta VdQ$ and $K_{FB}$ as well as values of the rich side rectangular width $T_{KR}$ and the lean side rectangular width $T_{KL}$ are also updated (learned) for each of the running regions of the engine.

Further, the magnitude $\Delta A$ may be mapped for the Kalman's frequency or for a reciprocal number to the Kalman's frequency, or alternatively it may have a constant value (including a case wherein it has a constant value for the entire running region of the engine and another case wherein it has a constant value for each of a plurality of portions of the running region of the engine).

Then, in case a ratio between the rich side time width $T_{KR}$ and the lean side time width $T_{KL}$ is changed as shown in FIG. 14 upon compulsory oscillation, the transient responsiveness when the running condition of the engine is changed can be compensated for.

It is a matter of course that the method of changing or correcting, in such compulsory oscillations, a median and a magnitude of an air fuel ratio, a cycle, a ratio between a rich side time width and a lean side time width and so forth in response to an output of the $O_2$ sensor 18 can be applied to any waveform of compulsory oscillations (triangular waves, rectangular waves, sine waves, and so forth).

While in the first embodiment described above the $O_2$ sensor 18 is described disposed either in the inside of the catalytic converter 9 or in the exhaust gas path on the downstream side of the catalytic converter 9, the location of the $O_2$ sensor 18 may otherwise be on the upstream side of the catalytic converter 9.

Figure 15:
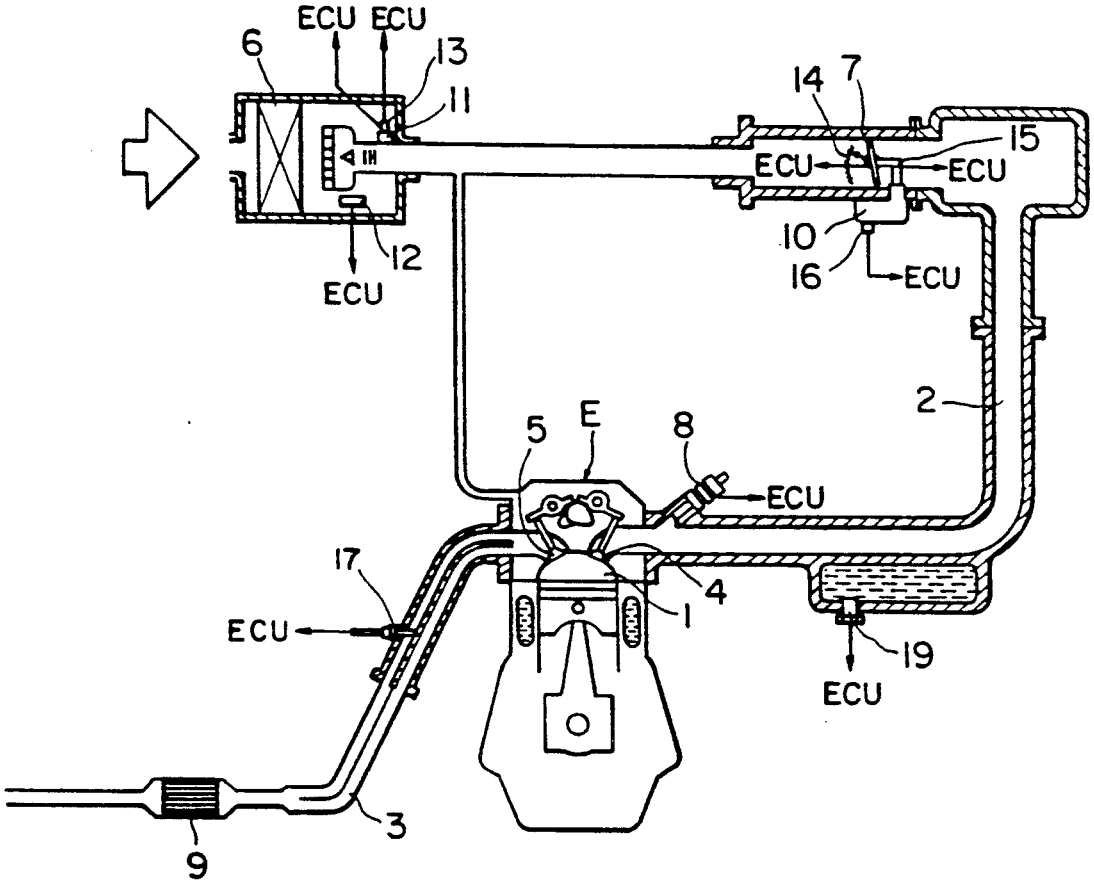
FIG. 15 is a diagrammatic representation of an internal combustion engine similar to FIG. 3 but showing a second embodiment of the present invention.
Figure 16:
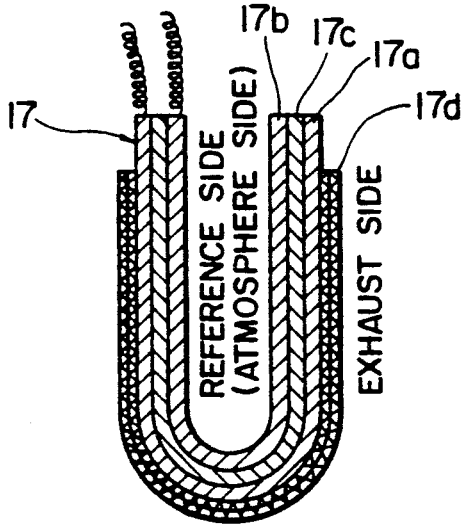
FIG. 16 is a schematic sectional view an $O_2$ sensor employed in the internal combustion engine shown in FIG. 15.

FIG. 15 shows an entire engine system according to a second embodiment of the present invention, and an $O_2$ sensor employed in the engine system of FIG. 15 is schematically shown in FIG. 16. The engine system of the second embodiment is substantially similar to the engine system of the first embodiment described hereinabove and only different from the latter in that the $O_2$ sensor denoted at 17 is located on the upstream side of the catalytic converter 9, and that the $O_2$ sensor 17 has such a construction as shown in FIG. 16 wherein an exhaust gas path side electrode 17*a* is substantially covered with a catalyzer layer (three-way catalyst layer) 17*d* having an oxidation-reduction characteristic. It is to be noted that reference character 17*b* in FIG. 16 denotes a platinum electrode on the atmosphere side, and 17*c* denotes a solid electrolyte layer composed of $ZrO_2$ or the like. Also in the case of the second embodiment, exhaust gas in the exhaust gas path is processed by the catalyzer (in this instance, catalyzer layer) 17*d* and then introduced to the exhaust gas path side electrode 17*a* similarly as in the first embodiment described above. Accordingly, the control λ point of the $O_2$ sensor 17 is maintained proximate the theoretical air fuel ratio. Accordingly, in case similar air fuel ratio control to that executed in the first embodiment is executed with an engine which has a hardware structure of the second embodiment, substantially similar operations and effects to those of the first embodiment can be naturally anticipated also with the second embodiment. It is to be noted that, in the case of the second embodiment, catalyzer may be provided separately at a stage prior to the $O_2$ sensor instead of provision of the catalyzer layer 17*d*.

Further, various means may be employed, in addition to such means which employs the solenoid valves 8 as described above, for the means for controlling the air fuel ratio. For example, the means may employ an electronically controllable metering mechanism provided for a carburetor (so-called electronically controlled carburetor). Or else, the means may supply air to the engine combustion chambers bypassing a carburetor.

Having now fully described the invention, it will be apparent to one of ordinary skill in the art that many changes and modifications can be made thereto without departing from the spirit and scope of the invention as set forth herein.

What is claimed is:

1. An apparatus for controlling the air fuel ratio of an internal combustion engine, comprising a catalytic converter interposed in an exhaust gas path of said internal combustion engine for purifying exhaust gas discharged from a combustion chamber of said internal combustion engine, an oxygen concentration sensor of the λ type located in said exhaust gas path such that said oxygen concentration sensor is exposed to exhaust gas which has passed through said catalytic converter, said oxygen concentration sensor having an output value which reflects a sudden change with respect to a theoretical air fuel ratio, an air fuel ratio modifying means for compulsorily varying the air fuel ratio of air fuel mixture, which is to be introduced into said combustion chamber, to a rich side and a lean side periodically in a desired cycle set irrespective of the output value of the oxygen concentration sensor to periodically change the excess air ratio λ of exhaust gas to be introduced into said catalytic converter, and a control means for controlling operation of said air fuel ratio modifying means in response to the output value of said oxygen concentration sensor, the excess air ratio λ of exhaust gas which is introduced into said catalytic converter being periodically varied while the excess air ratio λ is maintained on average approximately equal to 1.

2. An apparatus as claimed in claim 1, wherein said control means includes a smoothing means for smoothing an output of said oxygen concentration sensor, and a comparison means for comparing an output of said smoothing means with an aimed value which is set between a maximum output and a minimum output of said oxygen concentration sensor, and said control means controls operation of said air fuel ratio modifying means so that the output of said smoothing means may approach the aimed value.

3. An apparatus as claimed in claim 2, wherein said smoothing means includes a sampling means for successively sampling the output of said oxygen concentration sensor, and a calculating means for repetitively calculating latest smoothed output data V(n) from a latest output v of said sampling means and a smoothed output data V(n−1) calculated in the preceding cycle in accordance with the following equation:

$$V(n)=(1-k)\cdot V(n-1)+k\cdot v$$

k being a value greater than 0 but smaller than 1, said comparison means comparing the smoothed output data V(n) with the aimed value.

4. An apparatus as claimed in claim 2, wherein said air fuel ratio modifying means operates such that the air fuel ratio of air fuel mixture to be introduced into said combustion chamber may be set alternately to a lean side value and a rich side value on the opposite sides of an air fuel ratio median which is set at an excess air ratio λ equal to or proximate 1, and said control means controls, in response to an output of said comparison means, at least a ratio between a time width within which the air fuel ratio presents a lean side value and another time width within which the air fuel ratio presents a rich side value.

5. An apparatus as claimed in claim 4, wherein said control means includes an updating means for updating, in response to an output of said comparison means, control data with which operation of said air fuel ratio modifying means is to be controlled, said control means controlling the ratio between the times and the air fuel ratio median, the control data including instantaneous value data which is set in response to a latest output of said comparison means and integrated value data which is increased or decreased in response to an output of said comparison means, the ratio between the times being controlled in response to the instantaneous value data while the air fuel ratio median is controlled in response to the integrated value data.

6. An apparatus as claimed in claim 2, wherein said air fuel ratio modifying means operates so that the air fuel ratio of air fuel mixture to be introduced into said combustion chamber may be set alternately to a lean side value and a rich side value on the opposite sides of an air fuel ratio median which is set at an excess air ratio λ equal to or proximate 1, and said control means controls the air fuel ratio median in response to an output of said comparison means.

7. An apparatus as claimed in claim 6, wherein said control means includes an updating means for updating, in response to an output of said comparison means, control data with which operation of said air fuel ratio modifying means is to be controlled, the control data including at least one of instantaneous value data which is set in response to a latest output of said comparison means and integrated value data which is increased or decreased in response to an output of said comparison means, the air fuel ratio median being controlled in response to the control data.

8. An apparatus as claimed in claim 2, further comprising a flow rate sensor for detecting either a flow rate of exhaust gas of said internal combustion engine or a flow rate of working fluid of said internal combustion engine which has a correlation with a flow rate of exhaust gas of said internal combustion engine, said control means including an updating means for updating, in response to an output of said comparison means and an output of said flow rate sensor, control data with which operation of said air fuel ratio modifying means is to be controlled.

9. An apparatus as claimed in claim 8, wherein said air fuel ratio modifying means operates so that the air fuel ratio of air fuel mixture to be introduced into said combustion chamber may be set alternately to a lean side value and a rich side value on the opposite sides of an air fuel ratio median which is set at an excess air ratio λ equal to or proximate 1, the control data at least including integrated value data which is increased or decreased in response to an output of said comparison means and the changing rate of which is varied in response to an output of said flow rate sensor, the air fuel ratio median being controlled in response to the integrated value data.

10. An apparatus as claimed in claim 9, wherein said updating means updates the integrated value data in response to an output of said comparison means each time it is detected by said flow rate sensor that the integrated value either of the flow rate of exhaust gas or of the flow rate of the working fluid reaches a predetermined value.

11. An apparatus as claimed in claim 9, wherein the control data include the integrated value data and instantaneous value data which is set in response to a latest output of said comparison means, and the air fuel ratio median is controlled in response to the instantaneous value data and the integrated value data.

12. An apparatus as claimed in claim 9, wherein the control data includes instantaneous value data which is set in response to a latest output of said comparison means, and a ratio between a time width within which the air fuel ratio presents a lean side value and another time width within which the air fuel ratio presents a rich side value is controlled in accordance with the instantaneous value data.

13. An apparatus as claimed in claim 8, wherein said flow rate sensor is constituted from an intake air flow rate sensor which detects a flow rate of intake air introduced into said combustion chamber.

14. An apparatus as claimed in claim 1, further comprising a flow rate sensor for detecting either a flow rate of exhaust gas of said internal combustion engine or a flow rate of working fluid of said internal combustion engine which has a correlation with a flow rate of exhaust gas of said internal combustion engine, said air fuel ratio modifying means operating, in response to an output of said flow rate sensor, so that the cycle of variation of the air fuel ratio of air fuel mixture to be introduced into said combustion chamber may be varied in response to an output of said flow rate sensor.

15. An apparatus as claimed in claim 14, wherein said flow rate sensor is constituted from an intake air flow rate sensor which detects a flow rate of intake air introduced into said combustion chamber.

16. An apparatus as claimed in claim 1, wherein said is a preset cycle.

17. An apparatus as claimed in claim 1, wherein at least one of said cycle and a range of variations of the air fuel ratio of the air fuel mixture is preset for each operation state of the engine.

18. An apparatus as claimed in claim 1, wherein said air fuel ratio modifying means operates such that the air fuel ratio of air fuel mixture to be introduced into said combustion chamber may be set alternately to a lean side value and a rich side value on opposite sides of an air fuel ratio median which is set at an excess air ratio λ equal to or proximate 1, and said control means controls, in response to the output of said oxygen concentration sensor, a ratio of a time period wherein the air fuel ratio has a lean side value and another time period wherein the air fuel ratio has a rich side value.

19. An apparatus as claimed in claim 1, wherein said air fuel ratio modifying means operates such that the air fuel ratio of air fuel mixture to be introduced into said combustion chamber may be set alternately to a lean side value and a rich side value on opposite sides of an air fuel ratio median which is set at an excess air ratio λ equal to or proximate 1, and said control means controls the air fuel ratio median in response to the output of said oxygen concentration sensor.

20. An apparatus as claimed in claim 1, wherein the oxygen concentration sensor is arranged in said exhaust gas path on the downstream side of said catalytic converter.

21. An apparatus as claimed in claim 1, wherein the oxygen concentration sensor is arranged inside said catalytic converter.

22. An apparatus for controlling the air fuel ratio of an internal combustion engine, comprising a first catalytic converter interposed in an exhaust gas path of said internal combustion engine for purifying exhaust gas discharged from a combustion chamber of said internal combustion engine, an oxygen concentration sensor of the λ type provided in said exhaust gas path on a side upstream from the first catalytic converter and having an output value which reflects a sudden change with respect to a theoretical air fuel ratio, a second catalytic converter wherein exhaust gas which has passed through said second catalytic converter is guided to the oxygen concentration sensor, air fuel ratio modifying means for compulsorily varying the air fuel ratio of air fuel mixture, which is to be introduced into said combustion chamber, to a rich side and a lean side periodically in a desired cycle set irrespective of the output value of the oxygen concentration sensor to periodically change the excess air ratio λ of exhaust gas to be introduced into said first catalytic converter, and a control means for controlling operation of said air fuel ratio modifying means in response to the output value of said oxygen concentration sensor, the excess air ratio λ of exhaust gas which is introduced into said first catalytic converter being periodically varied while the excess air ratio λ is maintained on average approximately equal to 1.

* * * * *